US007874107B1

(12) United States Patent
Medley et al.

(10) Patent No.: US 7,874,107 B1
(45) Date of Patent: Jan. 25, 2011

(54) CONVERTIBLE HARD SIDE SHELTER

(75) Inventors: Martin A. Medley, Bradenton, FL (US); Amadeu Pereira, Cream City, NJ (US)

(73) Assignee: Global Engineering Marketing, LLC, Bradenton, FL (US)

( * ) Notice: Subject to any disclaimer, the term of this patent is extended or adjusted under 35 U.S.C. 154(b) by 1630 days.

(21) Appl. No.: 10/957,473

(22) Filed: Oct. 4, 2004

(51) Int. Cl.
*E04B 1/346* (2006.01)
*E04H 1/00* (2006.01)
*B65D 88/00* (2006.01)

(52) U.S. Cl. ..... 52/79.5; 52/71; 220/1.5

(58) Field of Classification Search ..... 52/71, 52/79.5; 220/1.5
See application file for complete search history.

(56) References Cited

U.S. PATENT DOCUMENTS

| | | | | | |
|---|---|---|---|---|---|
| 2,886,856 | A * | 5/1959 | Che | 52/69 |
| 4,534,141 | A * | 8/1985 | Fagnoni | 52/68 |
| 4,633,626 | A * | 1/1987 | Freeman et al. | 52/71 |
| 5,237,784 | A * | 8/1993 | Ros | 52/79.5 |
| 5,345,730 | A * | 9/1994 | Jurgensen | 52/64 |
| 5,596,844 | A * | 1/1997 | Kalinowski | 52/79.5 |
| 5,761,854 | A * | 6/1998 | Johnson et al. | 52/69 |
| 5,966,956 | A * | 10/1999 | Morris et al. | 62/259.1 |
| 6,296,132 | B1 * | 10/2001 | Pickler | 220/1.5 |
| 6,712,414 | B2 * | 3/2004 | Morrow | 296/26.01 |
| 6,983,567 | B2 * | 1/2006 | Ciotti | 52/79.5 |
| 6,997,495 | B1 * | 2/2006 | Groezinger | 296/26.15 |
| 7,117,645 | B2 * | 10/2006 | Bzorgi | 52/79.5 |
| 7,540,390 | B2 * | 6/2009 | Bublitz et al. | 220/1.5 |
| 2007/0107321 | A1 * | 5/2007 | Sarine et al. | 52/71 |
| 2009/0217600 | A1 * | 9/2009 | De Azambuja | 52/79.5 |
| 2009/0266006 | A1 * | 10/2009 | Gyory et al. | 52/79.5 |

FOREIGN PATENT DOCUMENTS

WO WO 9300230 A1 * 1/1993

* cited by examiner

*Primary Examiner*—Richard E Chilcot, Jr.
*Assistant Examiner*—Elizabeth A Plummer
(74) *Attorney, Agent, or Firm*—Boyle Fredrickson, S.C.

(57) ABSTRACT

A hard side shelter is convertible between transport and deployed modes. When in the transport mode, the shelter has an envelope that is the same as an ISO cargo container. Side sections unfold from a center section to convert the shelter into the deployed mode. A side section floor is connected to the center section for rotating between being coplanar with the center section floor when in the deployed mode and vertical and lying in a center section side plane when in the transport mode. Each side section has end and middle panels that are turnable relative to each other, and a door assembly that is turnable relative to the middle panels. Locking bars engage the center section floor when the shelter is in the transport mode, and engage the side section floors when the shelter is in the deployed mode. The shelter is handleable by pallet handling systems.

32 Claims, 13 Drawing Sheets

3
15B
24
15A
7
68
40
5
71
44
21
26
78
20
41
59
43
57
66
15C
22
15D
15
18
1
23

CONVERTIBLE HARD SIDE SHELTER

BACKGROUND OF THE INVENTION

1. Field of the Invention

The present invention pertains to portable shelters, and more particularly to hard side shelters that convert into different sizes for transportation and use.

2. Description of the Related Art

It is a well known practice to ship goods in International Standards Organization (ISO) containers. Such containers are very large, having nominal exterior dimensions of 19 feet 10½ inches long, eight feet wide, and eight feet high. The containers have fixed floors, roofs, and ends. Access to the container interior is through folding doors on both sides. The doors are locked closed by locking bars that engage tabs in the container floor and roof. The containers include an end bar and rails under the floor that are part of known pallet handling systems.

In theory, ISO containers could be used as hard side shelters for persons and equipment. However, despite their large size, they nevertheless are too small for some shelter purposes. For example, there is a need for shelters that are suitable for repairing large motor vehicle tires in the field. As is known, maintaining the tires of motor vehicles is mandatory for successful operation of the vehicles. A particularly difficult problem associated with tire maintenance concerns military trucks. Those trucks often operate off-road, in rough terrain, and far from repair facilities. A tire failure could jeopardize not only the truck crew in hostile areas, but even the success of the mission of which the truck is a part.

Repairing military truck tires is a difficult task. The tires and their rims and wheels are very heavy, so they require mechanical assistance to handle them. Failures associated with heavy truck tires are varied and severe, so a wide variety of large and heavy repair equipment has to be available. Finally, it is vital that the repair equipment either be located close to where the tire damage occurs, or be able to quickly reach the location of the damaged truck. That means that the repair equipment must be able to travel with the trucks to remote and rugged places. Because of the size of the tire repair equipment and the working room required around them, conventional ISO containers are not suitable as tire repair workshops.

SUMMARY OF THE INVENTION

In accordance with the present invention, a hard side shelter is provided that converts between a transport mode and a deployed mode. This is accomplished by apparatus that includes a center section, and two side sections that selectively fold into and out of the center section.

The center section is preferably constructed with an envelope that is the size and shape of a conventional International Standards Organization (ISO) cargo container. When in the transport mode, the side sections fold into the center section such that the entire hard side shelter has the envelope of an ISO container. When in the transport mode, the convertible hard side shelter can be stacked, handled, and transported in the same way as ISO containers. When in the deployed mode, the side sections unfold from the sides of the center section to greatly increase the interior space available for personnel and equipment.

The center section is comprised of a sturdy frame having horizontal beams and vertical corner posts. The corner posts define vertical side planes and vertical end planes of the center section. The center section has a rigid roof and a rigid floor. At least one end of the center section has an opening and an end door. The second center section end may also have an opening and an end door, or the second end may be permanently closed. If the second end is permanently closed, the center section may include an end bar on the closed end and floor channels that enable the convertible hard side shelter to be handled by a conventional pallet handling system.

The center section end door may be a single end door or a double end door. The single end door is composed of a top door hinged to the frame near the roof and a bottom door hinged to the frame near the floor. The top and bottom doors pivot about respective horizontal axes. When the single end door is open, the top and bottom doors are generally horizontal and parallel to the center section roof and floor, respectively. When the single end door is closed, the top and bottom doors are vertical and lie in the associated center section end plane. The double end door is composed of the top and bottom doors hinged near the roof and floor, respectively, plus a pair of outer doors that are hinged to associated corner posts for pivoting about respective vertical axes. When the double end door is open, the top and bottom doors are horizontal and generally parallel to the center section roof and floor, respectively, and the outer doors are generally parallel to the side section side planes. When the double end door is closed, the top and bottom doors are vertical and lie generally in the associated center section end plane, and the two outer doors are also generally in the center section end plane and lie adjacent and outside of the top and bottom doors.

Each side section is comprised of a rigid floor, and a number of relatively turnable panels. In the preferred embodiment, the side section panels include a pair of end panels, a pair of middle panels, and a door assembly. The side section floor is rotatably connected to the center section. Each end panel is turnably mounted along one edge thereof to a center section corner post. A second edge of each end panel is turnably mounted to a first edge of a middle panel. Second edges of the middle panels are turnably mounted to opposite edges of the door assembly. According to one aspect of the invention, the door assembly is comprised of first and second door frames. The first door frame contains one or more side doors that swing about respective vertical axes. The second door frame has a filler panel. The two door frames are attachable to and detachable from each other. Each of the end and middle panels and the door assembly has at least one locking bar.

When the convertible hard side shelter is in the deployed mode, the side sections are outside of vertical side planes of the center section. Each side section floor is rotated to be generally coplanar with the center section floor. Each end panel is parallel to the center section end planes. The middle panels, as well as the door assembly, are perpendicular to the end panels. The locking bars engage the side section floors to lock the side sections rigidly to the center section. A cover extends from the center section roof to the top edges of the end and middle panels and the door assembly. Thus, each side section is a space bounded by the side section floor, two end panels, two middle panels, the door assembly, and the cover. The side sections are open to the interior of the center section. To maintain cleanliness inside the convertible hard side shelter from outside contaminants, the joints between the end panels and the center section corner posts, and the joints between the end and middle panels, are covered with flexible seals. When the convertible hard side shelter is in the deployed mode, personnel and equipment can enter and leave through the side section doors.

To convert the hard side shelter from the deployed mode to the transport mode, the covers are removed from over the side sections and allowed to hang vertically generally in the center section side planes. One edge of each side section door assembly is disconnected from the associated middle panel. If the door assembly has two door frames, the door frames are detached from each other instead of from a middle panel. The locking bars of the end and middle panels and the door assemblies are disengaged from the side section floors. The door assemblies are turned away from the center section such that they are not over the side section floors. Each side section floor is rotated to be parallel to and proximate a respective center section side plane. One or more winches may be used to assist rotating the side section floors. The winches are received in ISO locks in the center section corner posts. Slide locks or the like engage the center section frame to retain the side section floors vertical.

The door assemblies are then turned toward the center section and flat against the respective adjacent middle panels. The end and middle panels are turned to lie generally within a center section side plane and alongside the associated side section floor. The end and middle panels thus form the sides of the hard side shelter when it is in the transport mode. The locking bars on the end and middle panels then engage the center section frame to lock the end and middle panels to the center section frame. The result is a rigid hard side shelter having the envelope of an ISO cargo container. The convertible hard side shelter is then ready for handling and shipping in the same manner as an ISO container.

It is an important feature of the invention that the convertible hard side shelter is equipped with any of a wide variety of tools and machinery suitable to carry out particular desired tasks. For example, the convertible hard side shelter may be used as an office, kitchen, or medical station. A particularly important use for the convertible hard side shelter is as a tire maintenance workshop for heavy duty trucks. In that case, such items as an engine-driven generator, welding machine, air compressor, and tire repair tools are incorporated into the convertible hard side shelter. To assist moving such heavy items as the engine-generator set, the floor and bottom end door may have rails fixed to them. The engine-generator set is supported on a wheeled cart that rolls along the rails to locate the engine-generator set outside of the center section. Other tools and machinery may be arranged to fit entirely within the center section for transporting purposes and to be moveable into the side sections when the hard side shelter is converted into the deployed mode.

In the preferred embodiment, a wall panel is built into the cart that supports the engine-generator set. The wall panel has peripheral seals that match the opening of the center section at the end door. When the cart is outside of the center section, the wall panel covers and seals the center section end opening. In that way, noise, dirt, and fumes associated with the outside environment and the engine-generator set are blocked from reaching inside the convertible hard side shelter.

The method and apparatus of the invention, using a center section that is based on an conventional ISO cargo container, thus enables a hard side shelter to be set up in the field. The convertible hard side shelter is convertible between a transport mode suitable for transporting, and a deployed mode suitable for a variety of functions such as a fully equipped tire maintenance workshop.

Other advantages, benefits, and features of the invention will become apparent to those skilled in the art upon reading the detailed description of the invention and studying the drawings.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

General

Figure 1:
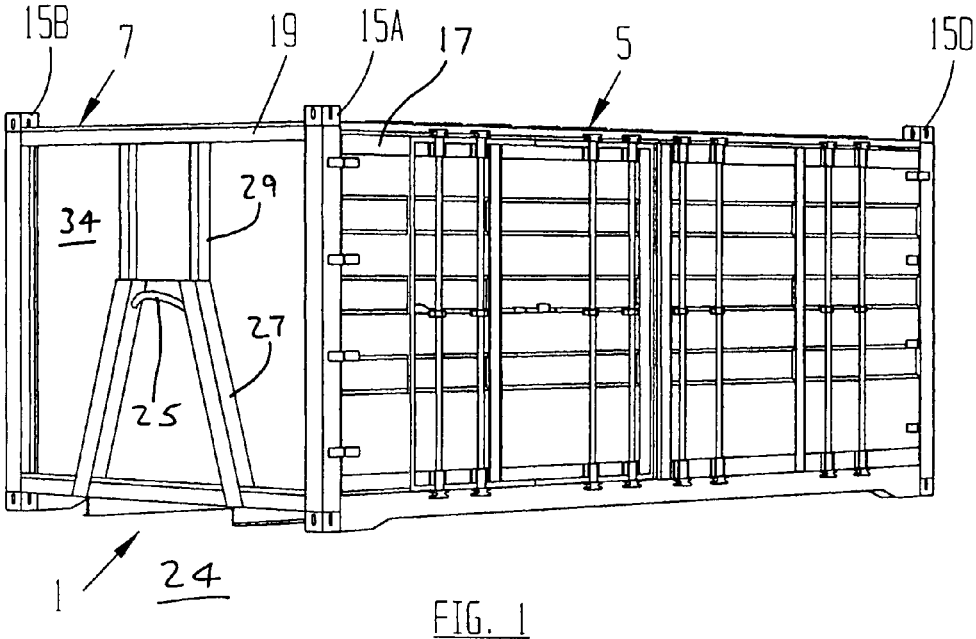
FIG. 1 is a perspective view of the front end and road side of the convertible hard side shelter in the transport mode.
Figure 2:
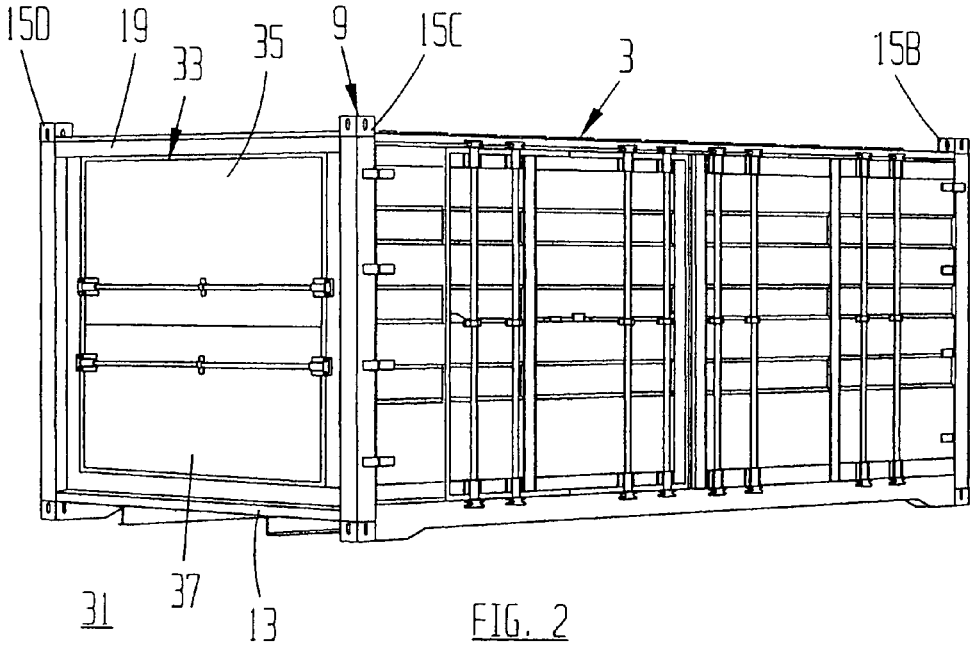
FIG. 2 is a perspective view of the back end and curb side of the convertible hard side shelter in the transport mode.
Figure 3:
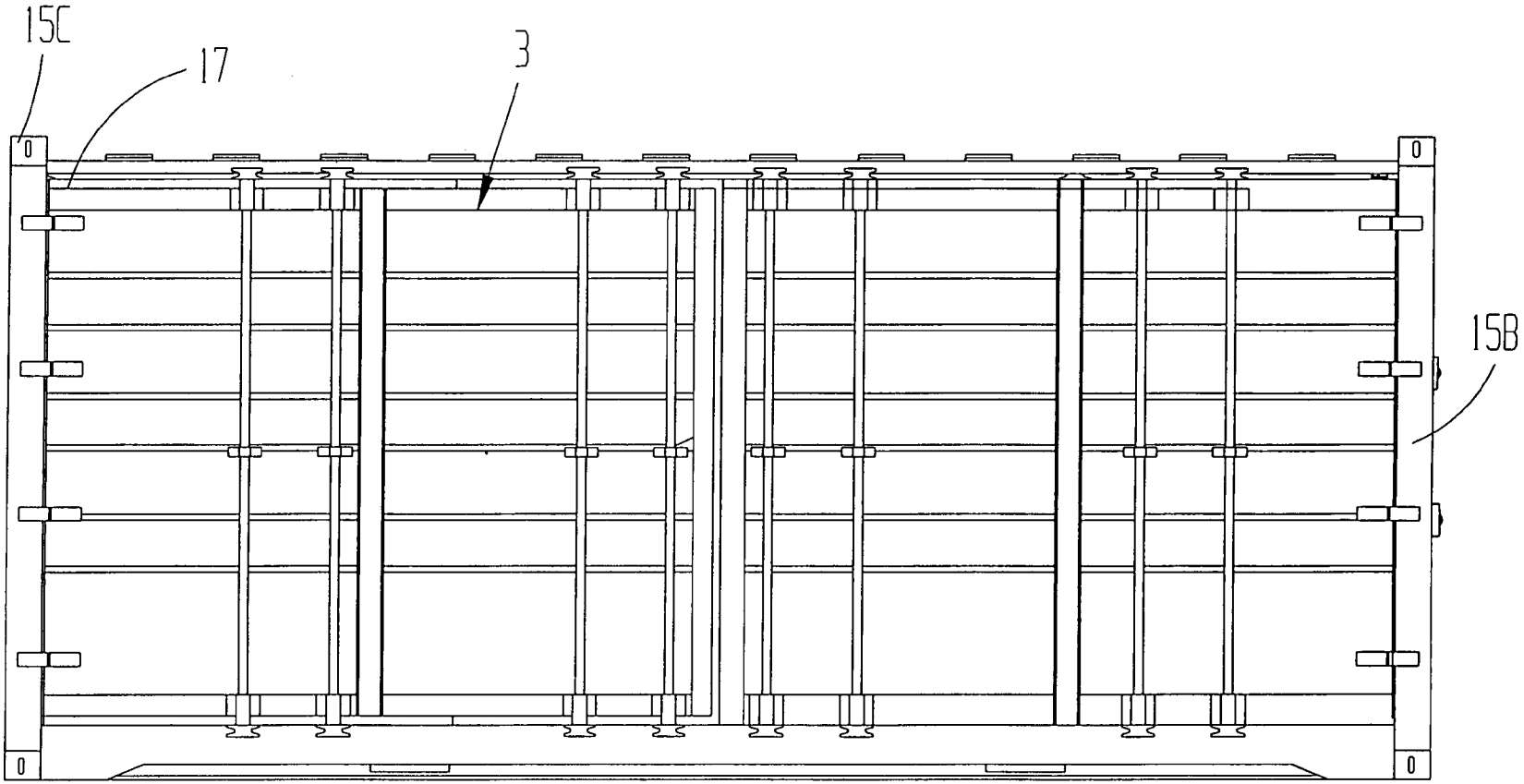
FIG. 3 is a broken view of the curb side of the convertible hard side shelter in the transport mode.

Referring first to FIGS. 1-3, a convertible hard side shelter 1 is illustrated that includes the present invention. The convertible hard side shelter 1 is particularly useful for performing heavy duty repair work at remote locations. However, it will be understood that the invention is not limited to maintenance related applications. On the contrary, the invention is also eminently suitable for such diverse uses as food preparation, medical procedures, restrooms, and offices.

Figure 6:
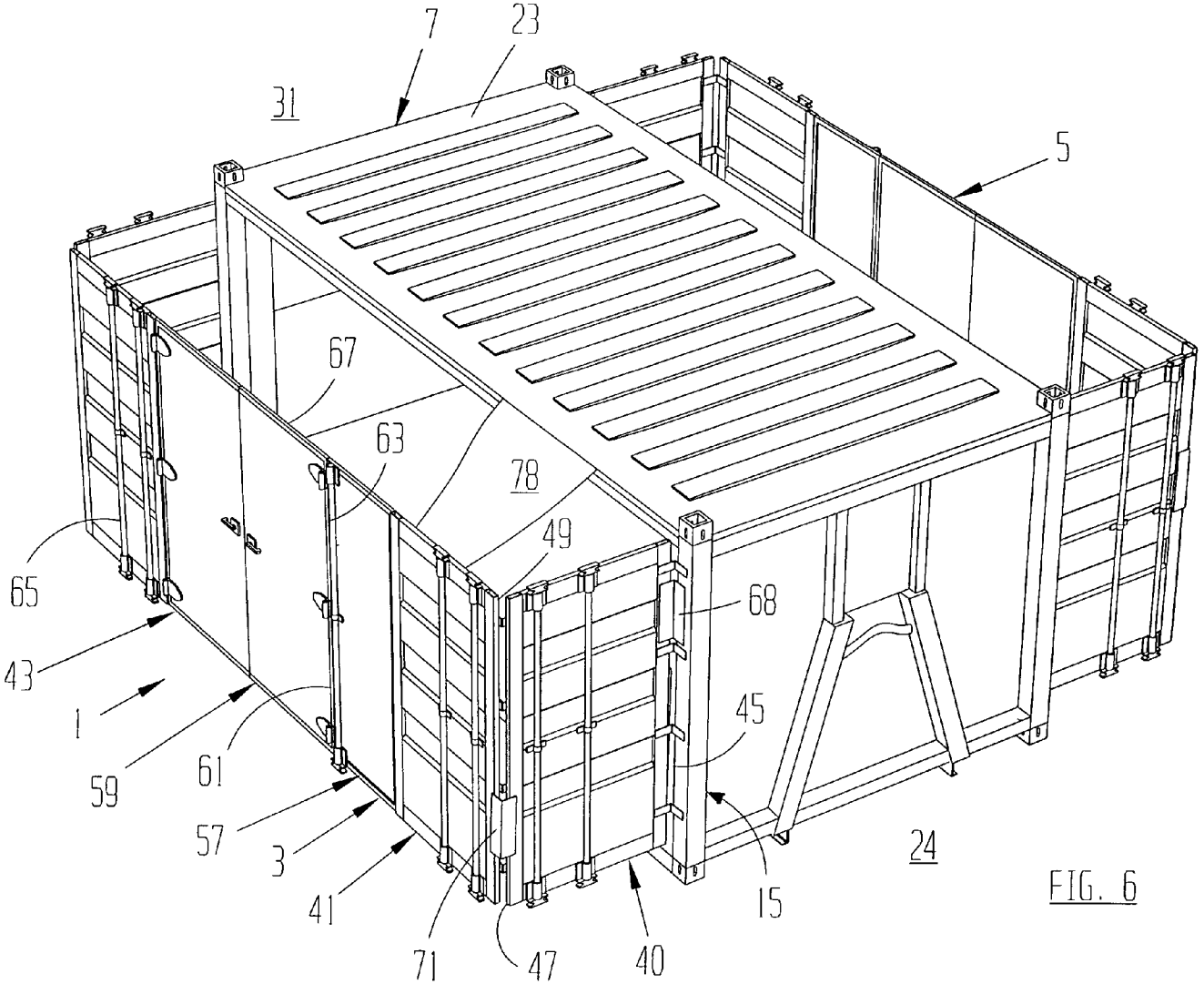
FIG. 6 is a perspective view of the convertible hard side shelter in the fully deployed mode.

In FIGS. 1-3 and 7, the convertible hard side shelter 1 is shown in a transport mode. FIGS. 6, 8, and 9 show the convertible hard side shelter in a deployed mode, as will be fully explained.

In the preferred embodiment, the convertible hard side shelter 1, when in the transport mode, has the exterior dimensions of a conventional International Standards Organization (ISO) cargo container. In the case, the convertible hard side shelter has an exterior length of 19 feet 10½ inches, a height of eight feet, and a width of eight feet. When in the transport mode, the convertible hard side shelter is handleable by a conventional pallet handling system as are known to persons working in the cargo container industry. Further, the convertible hard side shelters in the transport mode are stackable in the same way as conventional ISO cargo containers.

To convert it from the transport mode to the deployed mode, the convertible hard side shelter 1 has a curb side section 3 and a substantially identical road side section 5. The side sections 3 and 5 fold and unfold relative to a center section 7. When the side sections are folded into the center section 7, the convertible hard side shelter has the exterior dimensions of an ISO cargo container mentioned above.

Center Section

Figure 4:
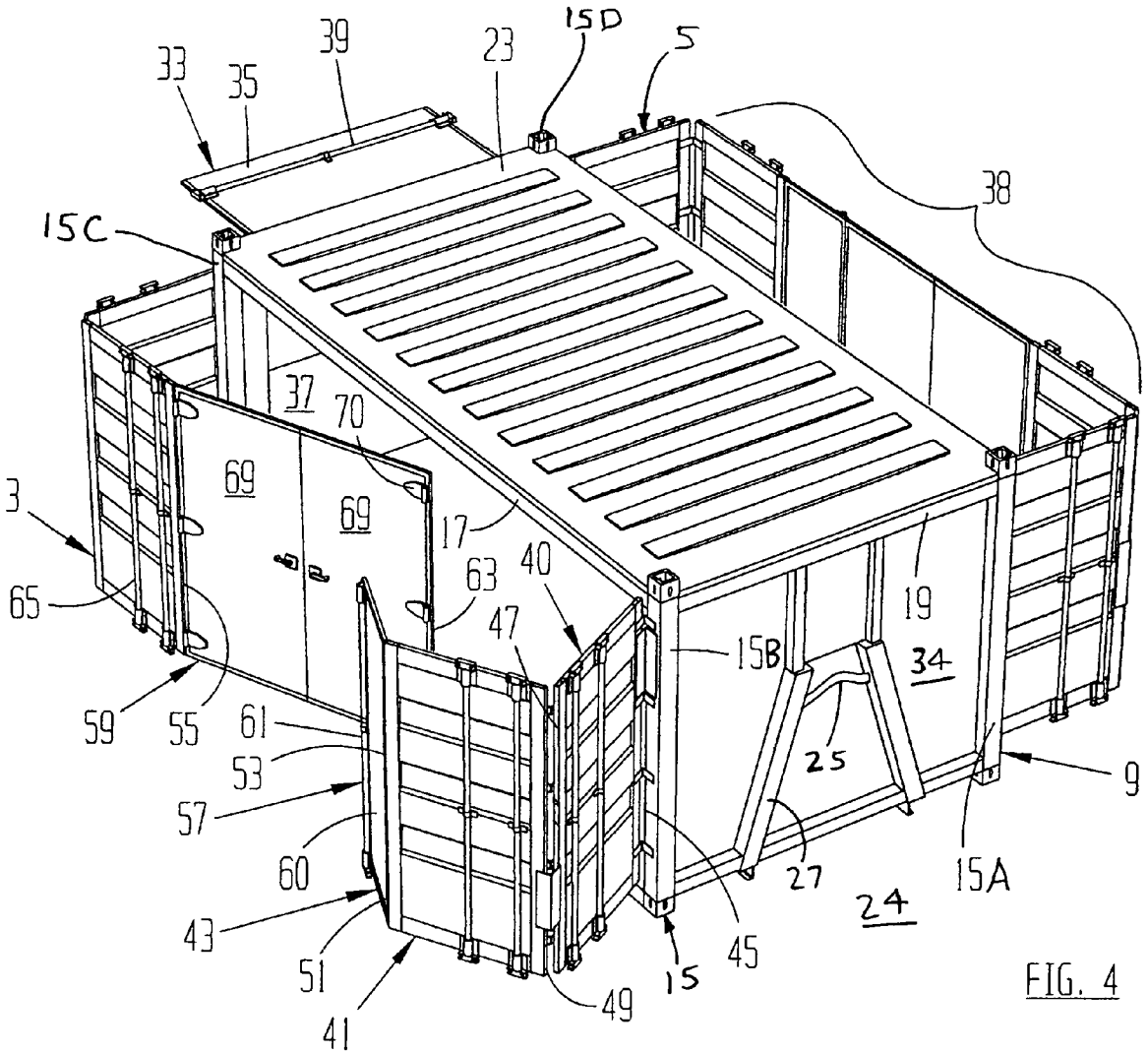
FIG. 4 is a perspective view of the front end of the convertible hard side shelter with the road side section in the deployed mode and the curb side section in a partially deployed mode.

The center section 7 is comprised of a sturdy frame 9 having horizontal and vertical beams. Looking especially at FIGS. 4 and 9, the particular frame 9 has bottom longitudinal beams 11, bottom transverse beams 13, top longitudinal beams 17, and top transverse beams 19. The frame further has four corner posts 15A, 15B, 15C, and 15D collectively referred to as reference numeral 15. The corner posts 15A, 15D and 15B, 15C define opposed vertical side planes of the center section that are indicated by reference numerals 20, FIG. 7. The corner posts 15A, 15B and 15C, 15D define center section end planes 22. A rigid floor 21 covers the bottom beams 11 and 13. A rigid roof 23 with an overhang covers the top longitudinal beams 17 and 19.

It is a feature of the convertible hard side shelter 1 that it is compatible with known pallet handling systems. For that purpose, the front end 24 of the center section 7 is manufactured with a strong bar 25 supported on its opposite ends by an A-frame 27. Preferably, the A-frame 27 terminates at vertical beams 29 that tie into a top transverse beam 19. The front end 24 of the center section is closed by a wall 34.

Also part of the convertible hard side shelter 1 are a pair of channels 30 under the frame bottom transverse beams 13. The channels 30 are spaced and configured to suit conventional pallet handling systems. The channels cooperate with the bar 25 to enable efficient handling of the convertible hard side shelter by known pallet handling machinery.

Figure 5:
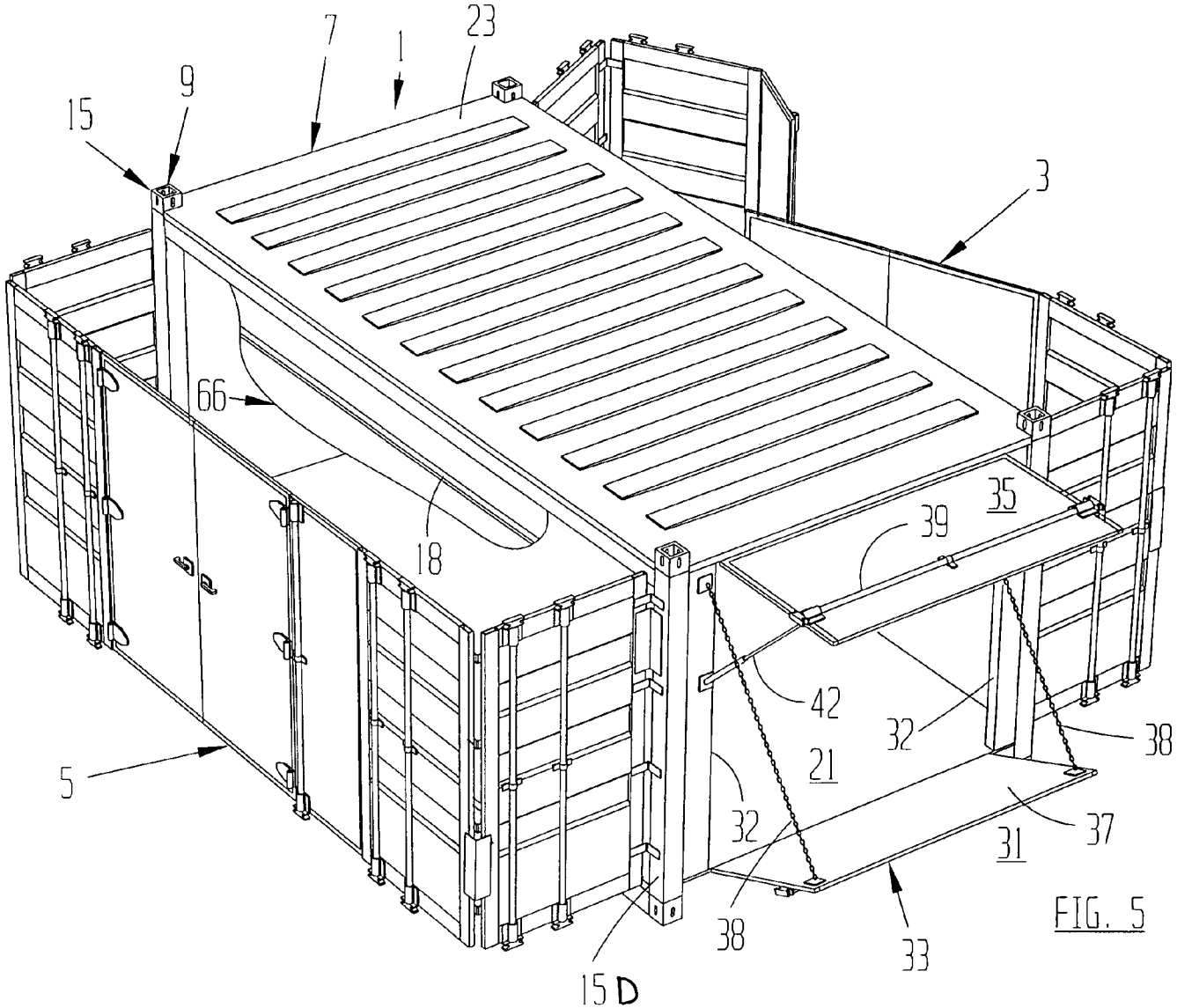
FIG. 5 is a view similar to FIG. 4 but showing the back end of the convertible hard side shelter.

The back end 31 of the center section 7 is designed with an end opening 32 to provide access to the interior of the convertible hard side shelter 1, FIG. 5. In the illustrated construction, there is an end door 33 at the opening 32. The end door 33 is comprised of a top door 35 that is hinged to a frame top transverse beam 19 for pivoting about a horizontal axis. A bottom door 37 is hinged to a frame bottom transverse beam 13 for pivoting about another horizontal axis. When the top and bottom doors 35 and 37, respectively, are open, they are generally parallel to the roof 23 and floor 21. When the doors 35 and 37 are open, the bottom door is held in place by heavy chains 38 secured to the frame 9. The top door is held open by gas-activated shock absorbers 42. When the top and bottom doors are closed, they lie generally in the center section end plane 22. Both doors are locked in place when closed by associated locking bars 39. The locking bars 39 may be constructed along the lines of the locking bars used on the doors of semi-trailers used in the trucking industry. The locking bars selectively engage and disengage tabs, not shown, on the frame corner posts 15.

Cover

Figures 7, 8:
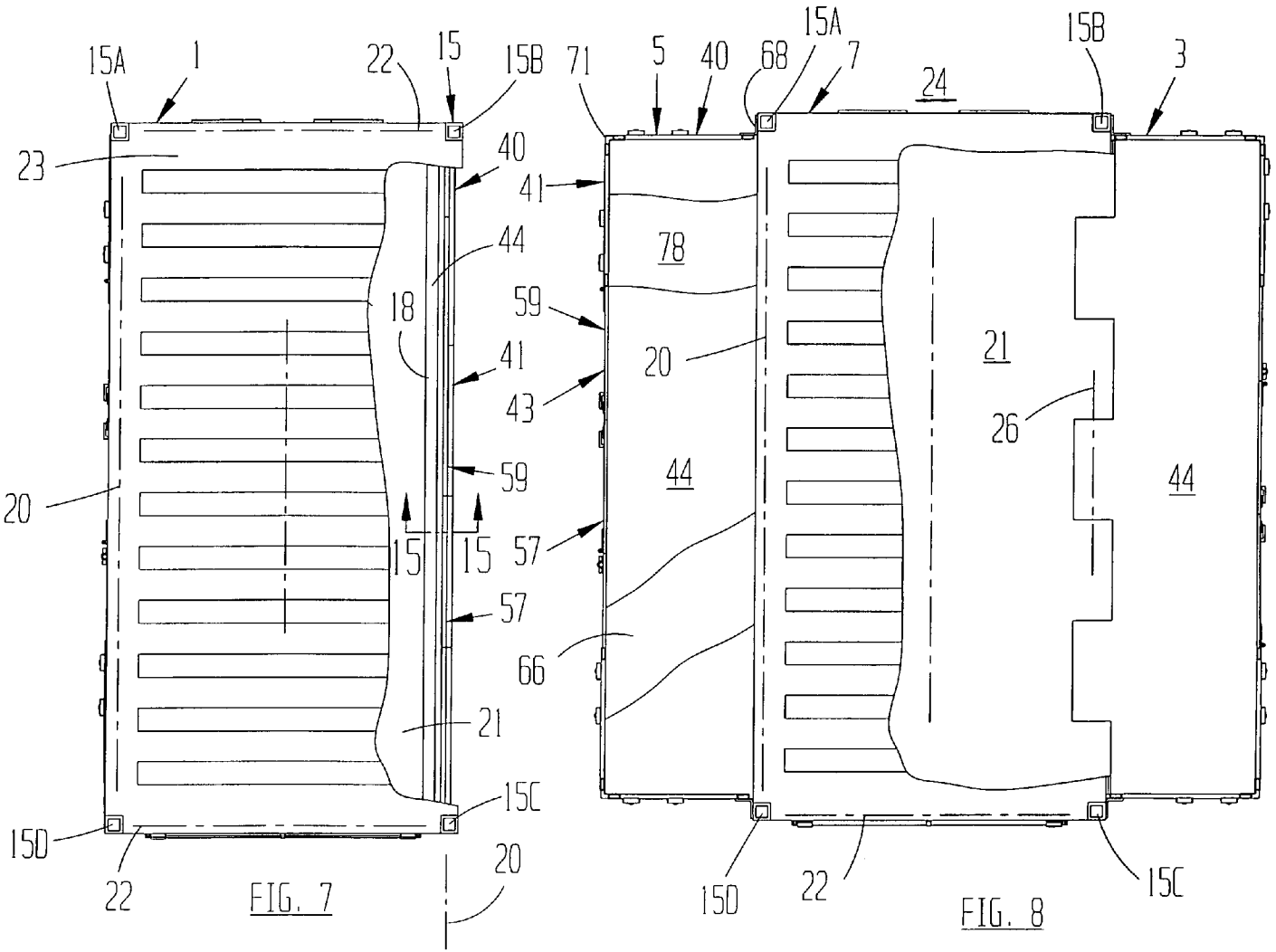
FIG. 7 is a broken top view of the convertible hard side shelter in the transport mode.
FIG. 8 is a broken top view of the convertible hard side shelter in the deployed mode.
Figure 9:
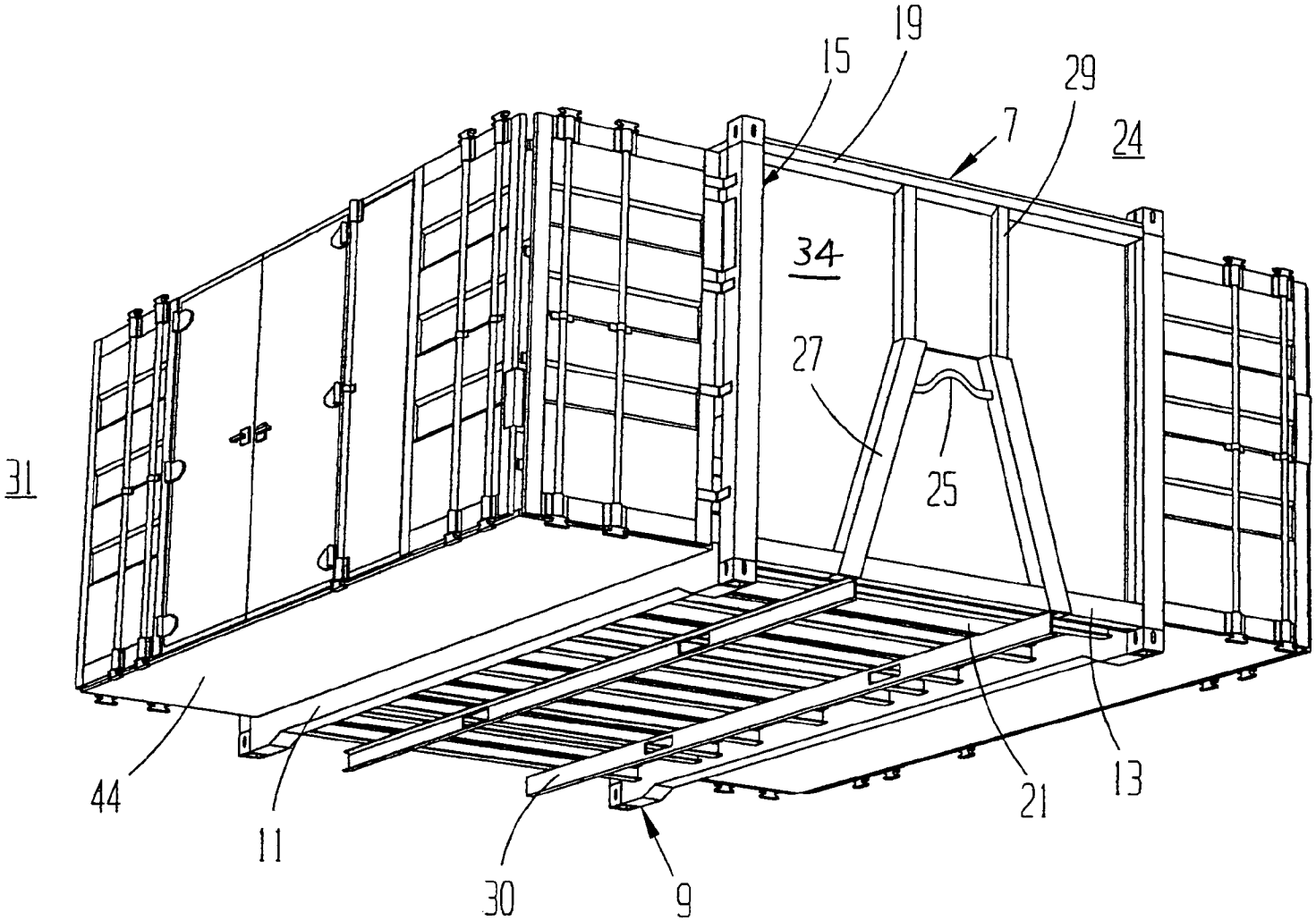
FIG. 9 is a perspective view of the bottom of the convertible hard side shelter in the partially deployed mode.
Figure 15:
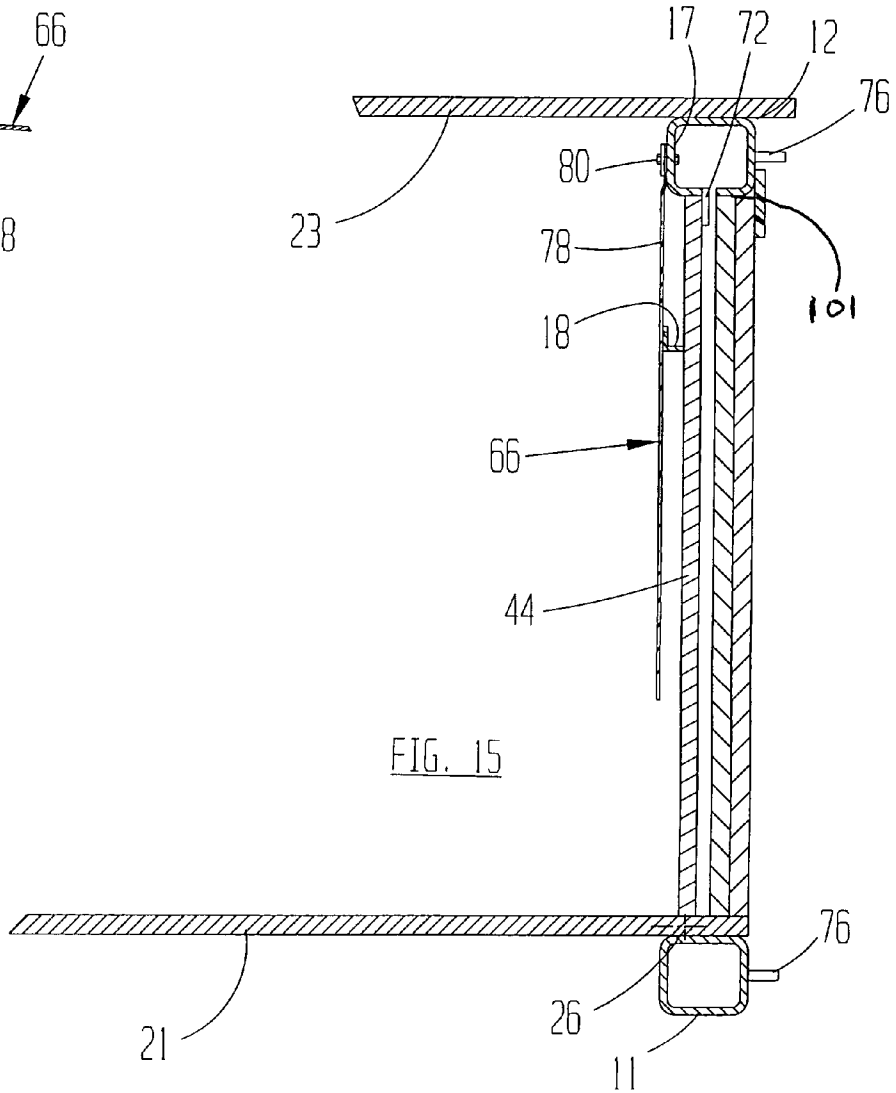
FIG. 15 is a cross-sectional view on an enlarged scale taken along line 15-15 of FIG. 7.

Turning briefly to FIGS. 5, 7, and 15, the convertible hard side shelter 1 comprises a cover 66 associated with each side section 3 and 5. Each cover 66 has a heavy tarp 78 hung from the top longitudinal beam 17 by suitable small plates and fasteners 80. A long angle 18 is fastened to the tarp 78 at a distance from the top beam. Several C-clamps, not shown in FIG. 5, 7, or 15, are built into the angle 18.

Side Sections

Looking especially at FIGS. 4-6, 8, and 9, the curb side section 3 and road side section 5 are comprised of a number of vertical panels collectively indicated at reference numeral 38 that are turnably mounted to each other. The curb side section and road side section are substantially identical. Accordingly, the following description of the curb side section is deemed adequate to also describe the road side section.

The panels 38 include a pair of end panels 40, a pair of middle panels 41, and a door assembly 43. Each side section 3 and 5 also has a rigid floor 44. Each end panel 40 has a first edge 45 that is turnably mounted to a center section corner post 15. A second edge 47 of each end panel is turnably mounted to a first edge 49 of a middle panel 41. A second edge 51 of each middle panel is turnably mounted to an opposite edge 53 or 55 of the door assembly 43. The floor 44 is connected to the center section, such as to frame bottom longitudinal beam 11, for rotating about a horizontal axis 26.

In the illustrated construction, the door assembly 43 is made up of a first door frame 57 and a second door frame 59. The first door frame 57 has a filler panel 60. The second door frame 59 is depicted as having two side doors 69 that swing about respective vertical axes, but a single side door is also within the scope of the invention. If desired, one of the side doors 69 may be a bi-fold door. The first door frame 57 has the door assembly edge 53, and the second door frame has the door assembly edge 55. As illustrated, the first door frame has a second edge 61, and the second door frame has a second edge 63. The door assembly also includes latches 70 between the first and second door frames. The latches 70 enable the two door frame edges 61 and 63 to attach to and detach from each other.

The floor 44, the pairs of end and middle panels 40 and 41, respectively, and the door assembly 43 of each side section 3 and 5 are foldable to convert the convertible hard side shelter 1 between the transport and deployed modes. Each of the end and middle panels and door assemblies has at least one locking bar 65. The locking bars 65 may be constructed generally along the lines of the locking bars 39 used on the center section end doors 35 and 37.

To prevent contaminants from passing between the center section corner posts 15 and the end panel edges 45, flexible but massive seals, partially shown at reference numeral 68, cover the joints between the corner posts and the end panel edges 45. Similar seals, partially shown at reference numeral 71, cover the joints between the end panel edges 47 and the middle panel edges 49.

As mentioned, FIGS. 6, 8, and 9 show the convertible hard side shelter 1 in the deployed mode. In the deployed mode, the entire side sections 3 and 5 are outside of the center section side planes 20. Specifically, the end panels 40 are parallel to the center section end plane 22. The middle panels 41 are perpendicular to the end panels. The door assembly edges 61 and 63 are attached to each other, and the door assembly 43 is coplanar with the middle panels. The side section floor 44 is rotated about the horizontal axis 26 to be coplanar with the center section floor 21. The locking bars 65 engage tabs in the side section floor to lock the end and middle panels and the door assembly to the side section floor. As a result, the side sections 3 and 5 become rigid with the center section 7. The seals 68 and 71 prevent outside contaminants from entering the convertible hard side shelter through the joints between the center section center posts 15 and the end panels, or through the joints between the end and middle panels.

Figure 17:
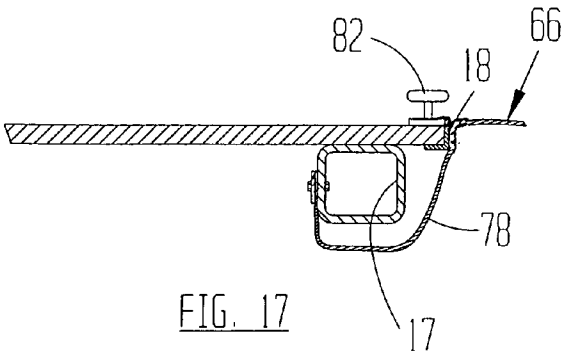
FIG. 17 is a partial view similar to FIG. 15, but showing the cover of the invention in the deployed mode.

The cover 66 is extended between the center section roof 23 and the common top edges 67 of the end and middle panels 40 and 41, respectively, and the door assembly 43. FIG. 17 shows the cover in the deployed mode. The tarp 78 is wrapped upwardly against the top longitudinal beam 17, and the angle 18 is secured to the roof overhang by means of several C-clamps 82 that are built into the angle. Three free edges of the tarp are folded over the top edges 67 of the end and middle panels and door assembly and held in place, such as with hook and eye fastening tape.

When in the deployed mode, a preferred embodiment of the invention has a total exterior width of approximately 19 feet eight inches. The convertible hard side shelter 1 in the deployed mode thus provides a sealed interior space that is much larger than the interior space of the center section 7 alone. Access to the interior is through the end door 33 and the side doors 69 in the second door frame 59.

Conversion

Figure 16:
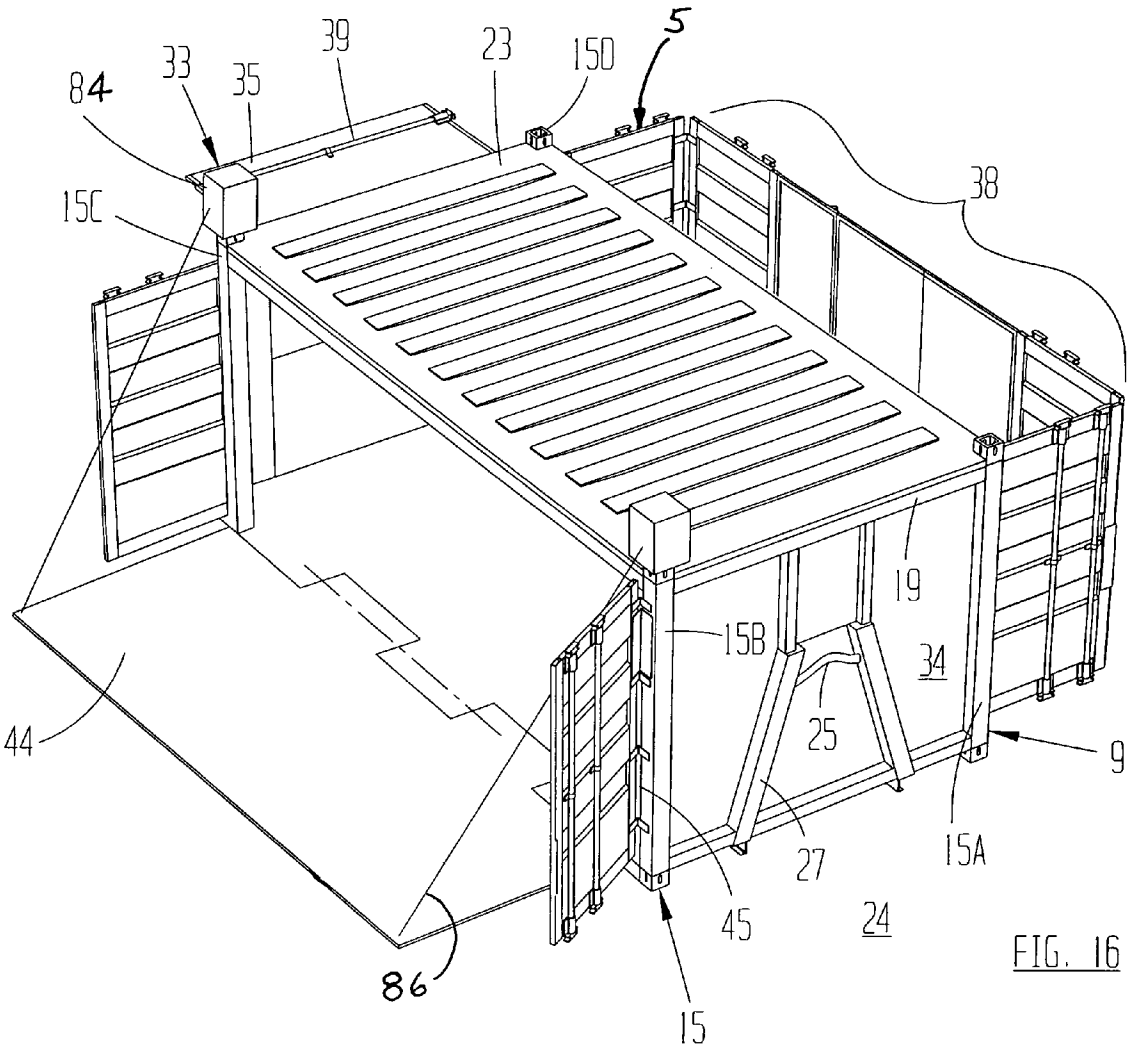
FIG. 16 is a perspective view showing winches used to assist rotating the side section floors.

To convert the convertible hard side shelter 1 from the deployed mode of FIGS. 6, 8, and 9 to the transport mode of FIGS. 1-3 and 7, the covers 66 are removed from the side section end panels 40, middle panels, 41, and door assembly 43. The C-clamps 82 are removed from the roof 23, and the tarp 78 is allowed to hang vertically, FIG. 15. The locking bars 65 are disengaged from the side section floor 44. The door assembly edges 61 and 63 are detached from each other. The end panels, middle panels, and door assembly are turned so as to not overlie the side section floors 44. Each side section floor is rotated upwardly to lie parallel to and proximate a vertical side plane 20. To assist rotating the side section floor, one or more winches 84 may be employed. See FIG. 16. The winches 84 are received in known ISO locks at the top ends of the corner posts 15. Flexible cables 86 from the winches are removeably hooked to the side section floor.

To retain the side section floor 44 vertical, it is provided with conventional slide locks 72. As seen in FIG. 15, the slide locks 72 engage the top longitudinal beam 17. However, the slide locks may engage the corner posts 15 instead, if desired. After the side section floor is properly retained, the cables 86 are unhooked from the floor, and the winches 84 are removed from the ISO locks. The winches and cables are also used to rotate the side section floors downwardly when the convertible hard side shelter 1 is converted back to the deployed mode.

The first door frame 57 is turned toward the center section 7 to lie flat against the adjacent middle panel 41. The other door frame 59 is turned to lie flat against the other middle panel. The middle panels are turned to be coplanar with the end panels 40. The end panels are turned on the center section corner posts 15 to lie alongside the associated side section floor 44. FIG. 15 shows heavy seals 101 on the end and middle panels that abut the top longitudinal beam 17.

The entire door assembly 43 thus lies generally within the center section side plane 20. Then the locking bars 65 are engaged with tabs 76 in the center section longitudinal beams 11 and 17. The end and middle panels 40 and 41, respectively, thus lock to the center section 7 and become rigid sides for the center section, and the entire convertible hard side shelter 1 has the envelope of an ISO container, FIG. 7. The convertible hard side shelter is then in the transport mode, ready to be handled by conventional pallet handling systems for stacking, shipping, and other handling operations.

Tire Maintenance Workshop

The convertible hard side shelter 1 is suitable for a wide variety of purposes. For example, it may be used to shelter military personnel at remote locations. It also is eminently useful for storing equipment and supplies at a remote site. An especially important use of the convertible hard side shelter is as a tire maintenance workshop. Looking at FIG. 10, the convertible hard side shelter is shown in the transport mode and equipped with machinery and tools for repairing heavy duty truck tires. The machinery may include a tire mounter and demounter schematically represented at reference numeral 73. Other machinery includes a press 75, air compressor 77, air reservoir 79, engine-generator set 81, safety cage 83, and tool box 85. In addition, such auxiliary equipment as a heat pump 87 can be incorporated into the convertible hard side shelter. Other infrastructure may include a fluorescent lighting system and an overhead crane or a jib crane built into the center section 7.

Figure 10:
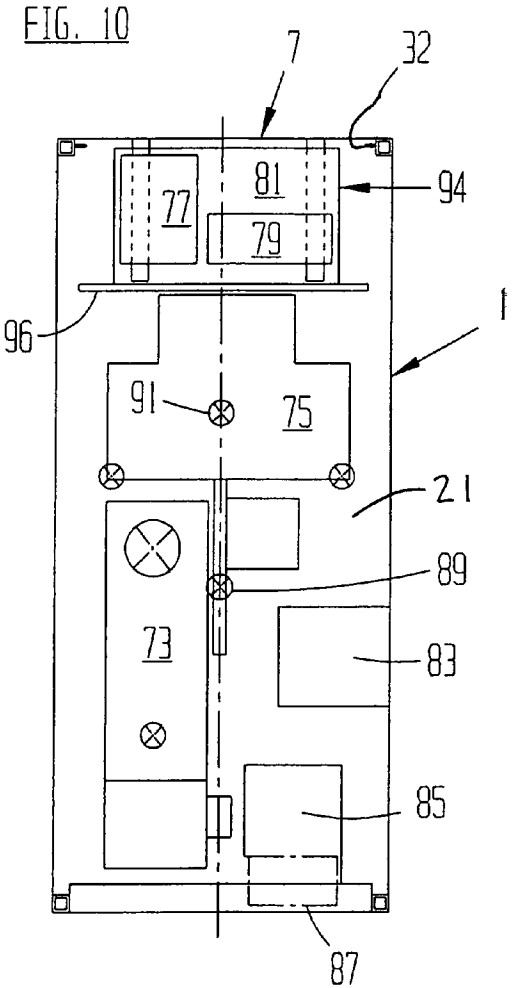
FIG. 10 is a top view of the convertible hard side shelter showing it in the transport mode and equipped to function as a tire maintenance workshop.

It is an important feature of the invention that some of the tire maintenance equipment is permanently installed in the convertible hard side shelter 1. For instance, in FIG. 10 the tire mounter and demounter 73 is installed to the center section floor 21 by a pivot pin 89. The press 75 is installed to the floor by another pivot pin 91. The pivot pins 89 and 91 enable the tire mounter and demounter and the press, respectively, to be permanently located within the center section 7, but to have different angular positions. In FIG. 10, all the equipment is shown in a storage location, fitting completely within the center section.

Figure 11:
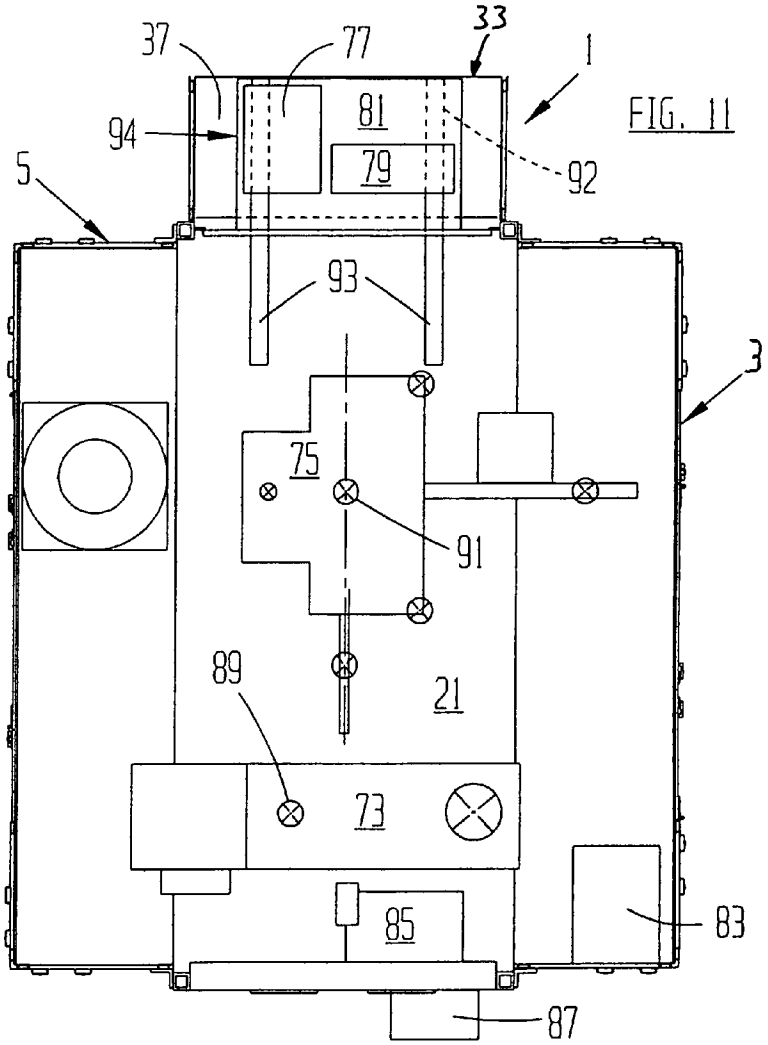
FIG. 11 is a view similar to FIG. 10, but showing the convertible hard side shelter in the deployed mode.

In FIG. 11 the convertible hard side shelter 1 is shown in the deployed mode, and the tire maintenance equipment is shown in their working locations. Specifically, the tire mounter and demounter 73 is rotated 90 degrees about the pivot pin 89 relative to its stored location of FIG. 10. Similarly, the press 75 is at 90 degrees about its pivot pin 91 relative to its stored position. FIG. 11 also shows a pair of rails 93 fixed to the center section floor 21 and matching rails 92 on the bottom door 37. The engine-generator set 81 is placed on a wheeled cart 94 that rolls along the rails 92 and 93. The extra space provided by the side sections 3 and 5 enables the tire repair equipment to be spaced apart and thereby provide ample working space for personnel performing tire maintenance. On the other hand, when the tire repair operations are needed at a different place, the equipment is returned to the storage locations of FIG. 10 for safe and efficient transport.

Figure 14:
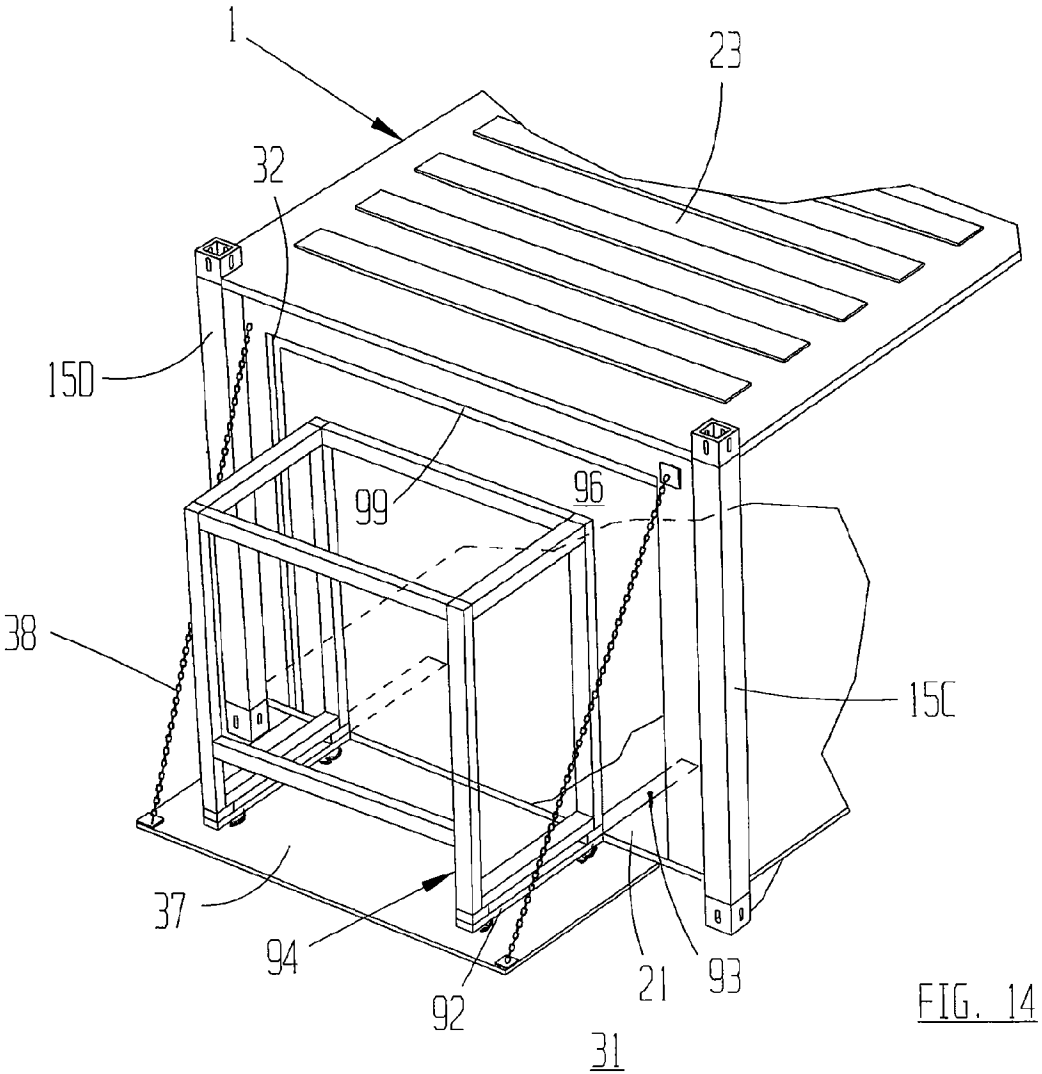
FIG. 14 is a broken perspective view showing the wall panel mounted to the cart that supports the engine-generator set.

A particularly important aspect of the present invention is that the center section opening 32 is coverable even when the end door 33 is open. Turning to FIG. 14, the center section back end 31 is shown with the end door open, thus providing access to the interior or the convertible hard side shelter 1. For clarity, the top door 35 is not shown. The cart 94 for the engine-generator set 81 (not illustrated in FIG. 14) is rolled onto the bottom door 37 along the rails 92 and 93. To cover the opening 32, a wall panel 96 is built into the cart 94 and rolls with it. The wall panel 96 has a size and shape that substantially matches the opening 32. When the cart to rolled onto the bottom door, the wall panel covers the opening 32. A seal 99 around the wall panel periphery helps to seal the interior of the convertible hard side shelter 1 from the noise and fumes of the engine-generator set 81 as well as from atmospheric pollutants.

Alternate Embodiments

Figure 12:
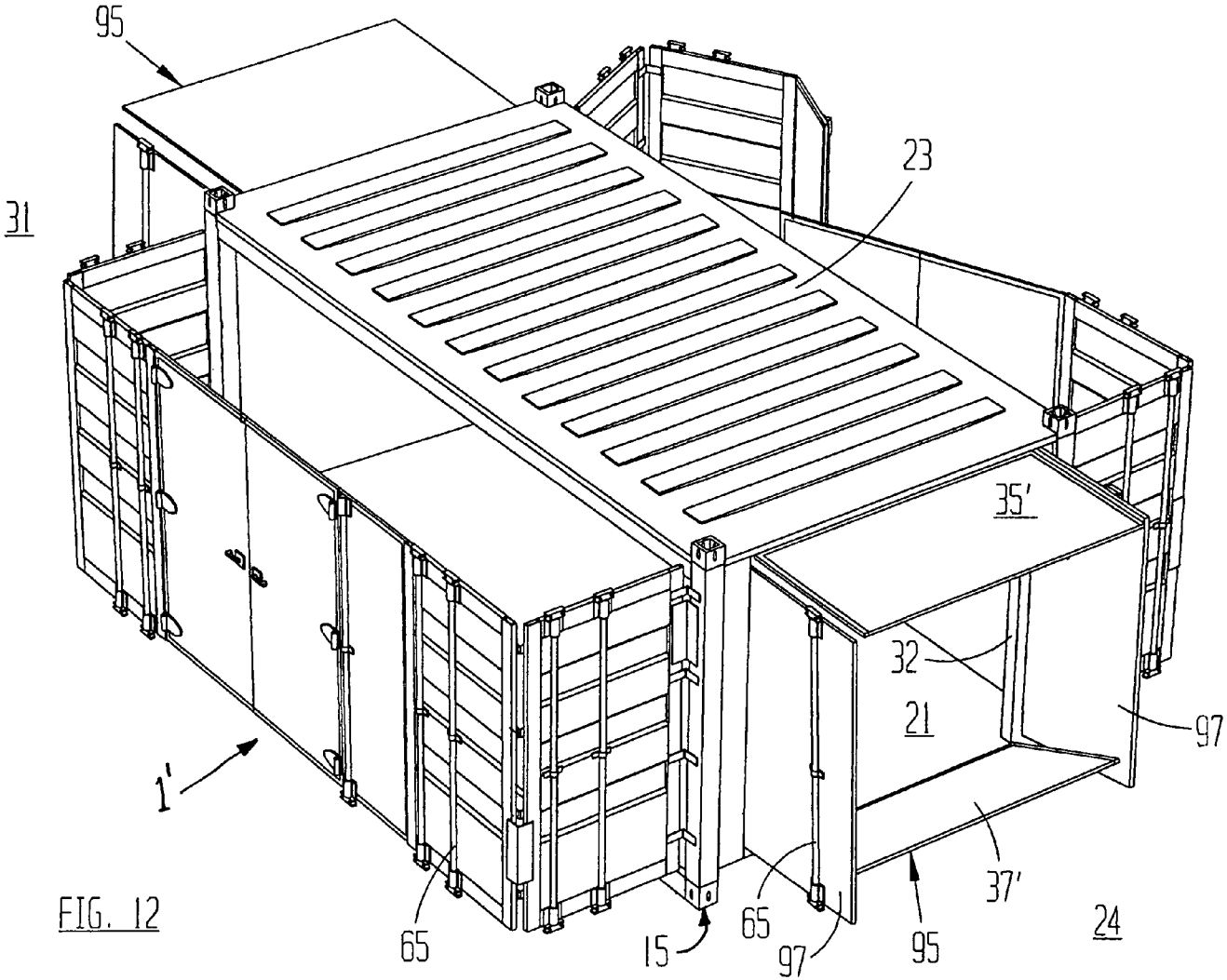
FIG. 12 is a view similar to FIG. 5, but showing an open double end door of the center section.
Figure 13:
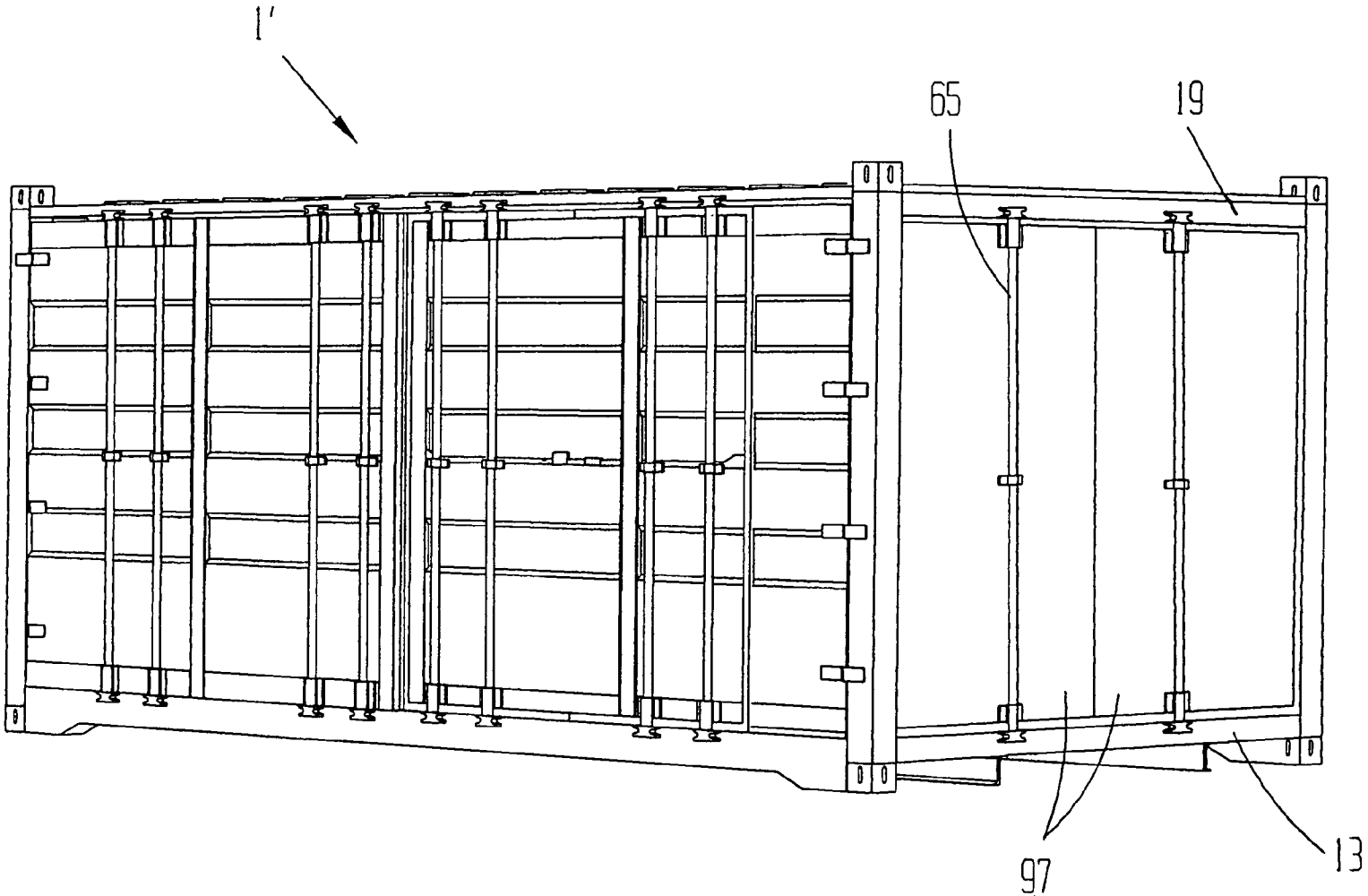
FIG. 13 is a view similar to FIG. 2 but showing the double end door of FIG. 12 closed.

As described thus far, the convertible hard side shelter 1 is constructed with the bar 25 and channels 30 that enable it to be handled by a conventional pallet loading system. The versatility of the invention is such that both center section ends 24 and 31 may be provided with end doors 33, thereby eliminating the bar 25. FIGS. 12 and 13 show a convertible hard side shelter 1' according to a further embodiment of the invention. The convertible hard side shelter 1' is constructed with a double end door 95 at both ends 24 and 31. It will be understood, of course, that a double end door 95 may be at only one end 24 or 31, if desired. The double end door is comprised of top and bottom doors 35' and 37', respectively, that may be substantially identical to the doors 35 and 37 described previously in connection with FIGS. 1-11. The double end door further comprises a pair of outer doors 97. Each outer door 97 is hinged to an associated corner post 15 for pivoting about a respective vertical axis. Each outer door includes at least one locking bar 65.

FIG. 12 shows the double end doors 95 open. In that situation the top doors 35' are generally parallel to the center section roof 23, the bottom doors 37' are generally coplanar with the center section floor 21, and the outer doors 97 are generally parallel to the center section side planes 20 (FIG. 8). FIG. 13 shows the double doors closed. The top and bottom doors 35' and 37', respectively, are vertical and are within the center section end planes 22. The outer doors are also generally within the end planes 22 and lie adjacent and outside of the top and bottom doors. The locking bars 65 securely lock the outer doors to the center section beams 13 and 19. The double end doors thus effectively seal the interior of the convertible hard side shelter 1' from outside contaminants such as sand and fumes.

CONCLUSION

In summary, the results and advantages of pallet handling systems for ISO cargo containers can now be more fully realized. The convertible hard side shelter provides both the ability to be transported and stored in the manner of ISO containers as well as to be converted into an expanded space for storing and working. This desirable result comes from using the combined functions of the side sections 3 and 5. When in a transport mode, the side sections fold so as to form the sides of the center section 7 having the same exterior envelope as an ISO container. A floor 44 of each side section lies vertically alongside the folded end and middle panels 40 and 41, respectively. The end and middle panels include locking bars 65 that engage the center section frame 9. The center section may include the bar 25 and channels 30 used with conventional pallet handling systems. When in a deployed mode, the side sections unfold. The side sections floors rotate to be coplanar with the center section floor 21. The end and middle panels and the door assemblies 53 lock to the side section floors to render the side sections rigid with the center section. Access to the interior of the convertible hard side shelter is through the side doors 69. The convertible hard side shelter is ideal for use as a portable tire maintenance workshop.

It will also be recognized that in addition to the superior performance of the convertible hard side shelter, its construction is such as to provide increased economy related to the transportation and storage of personnel and equipment. Also, because it follows a simple and rugged design, the convertible hard side shelter gives many years of service life with but minimal maintenance.

Thus, it is apparent that there has been provided, in accordance with the invention, a convertible hard side shelter that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A convertible hard side shelter comprising:

a. a center section having front and back ends and defining opposed first and second side planes and first and second end planes and comprising:
   i. a frame having a plurality of posts;
   ii. a center section floor on the frame;
   iii. a roof supported by the posts; and
   iv. an end door on at least the back end; and b. at least one side section comprising:
   i. a side section floor rotatably connected to the center section; and
   ii. a plurality of panels mounted to each other and to the center section for cooperating with the side section floor to selectively fold between a transport mode whereat the side section floor is parallel to and proximate the first center section side plane and the panels lie generally within the first center section side plane, and a deployed mode whereat the side section floor and the panels are substantially outside of the first center section side plane, wherein the center section end door comprises a top door hinged to the frame near the roof, and a bottom door hinged to the frame near the center section floor and wherein:

a. the center section back end defines an opening of predetermined size and shape;

b. the center section floor comprises first rails;

c. the bottom door comprises second rails that match the first rails;

d. a cart is selectively rollable along the first and second rails to be inside the center section when the cart is on the first rails and outside the center section with the cart is on the second rails; and e. a wall panel is on the cart and has the predetermined size and shape, the wall panel substantially covering the center section back end opening when the cart is outside the center section.

2. The convertible hard side shelter of claim 1, wherein the panels of the at least one side section comprise:

a. first and second end panels each turnably mounted to an associated center section post;

b. first and second middle panels each turnably mounted to an associated end panel; and c. a door assembly turnably mounted to the middle panels opposite the end panels, forming an extension of the panel of the at least one side section, the door assembly cooperating with the end and middle panels to convert the convertible hard side shelter between the transport mode whereat the end and middle panels, the side section floor, and the door assembly lie generally within the first center section side plane, and a deployed mode whereat the side section floor is generally coplanar with the center section floor and the end panels are generally parallel to the center section end planes and the middle panels are perpendicular to the center section end planes.

3. The convertible hard side shelter of claim 2 wherein the door assembly comprises:

a. a first door frame turnably mounted to the first middle panel;

b. a second door frame turnably mounted to the second middle panel; and c. means for attaching and detaching the first and second door frames to each other.

4. The convertible hard side shelter of claim 3 wherein the first door frame comprises at least one side door that provides access to the interior of the convertible hard side shelter when the convertible hard side shelter is in the deployed mode.

5. The convertible hard side shelter of claim 3 wherein the second door frame comprises a filler panel.

6. The convertible hard side shelter of claim 2 wherein the door assembly comprises at least two side doors that provide access to the interior of the convertible hard side shelter when the convertible hard side shelter is in the deployed mode.

7. The convertible hard side shelter of claim 2 further comprising means for locking the first and second end panels and the first and second middle panels to the center section floor when the convertible hard side shelter is in the transport mode, and for locking the first and second end panels and the first and second middle panels to the floor of the at least one side section when the convertible hard side shelter is in the deployed mode.

8. The convertible hard side shelter of claim 7 further comprising means for locking the door assembly to the floor of the at least one side section when the convertible hard side shelter is in the deployed mode.

9. The convertible hard side shelter of claim 2 further comprising a cover between the center section roof and the side section panels when the convertible hard side shelter is in the deployed mode.

10. The convertible hard side shelter of claim 9 wherein the cover hangs generally in a vertical plane parallel to the center section side plane when the convertible hard side shelter is in the transport mode.

11. The convertible hard side shelter of claim 2 further comprising:

a. at least one first locking bar on each end panel, at least one second locking bar on each middle panel, and at least one third locking bar on the door assembly;

b. first means for engaging the first and second locking bars when the convertible hard side shelter is in the transport mode; and c. second means for engaging the at least one first, second, and third locking bars when the convertible hard side shelter is in the deployed mode.

12. The convertible hard side shelter of claim 2 wherein the center section has a length of approximately 19 feet 10½ inches, a height of approximately eight feet, and a width of approximately eight feet when the convertible hard side shelter is in the transport mode.

13. The convertible hard side shelter of claim 2 wherein the convertible hard side shelter has a length of approximately 19 feet 10½ inches, a height of approximately eight feet, and a width of approximately eight feet when the convertible hard side shelter is in the deployed mode.

14. The convertible hard side shelter of claim 1 wherein the center section further comprises:

a. a wall covering the front end;

b. a bar on the front end wall; and c. a pair of channels under the center section floor that cooperate with the bar to render the convertible hard side shelter handleable by a pallet handling system when the convertible hard side shelter is in the transport mode.

15. The convertible hard side shelter of claim 1 wherein the center section comprises an end door at each of the center section front and back ends.

16. The convertible hard side shelter of claim 15 further comprising means for selectively locking the end door to the frame.

17. The convertible hard side shelter of claim 1 further comprising first seals between the end panels and the corner posts, and second seals between the end and middle panels.

18. The convertible hard side shelter of claim 1 further comprising at least one top locking bar for selectively locking the top door to the frame, and at least one bottom locking bar for selectively locking the bottom door to the frame.

19. The convertible hard side shelter of claim 1 further comprising means for retaining the side section floor parallel to and proximate the first center section side plane when the convertible hard side shelter is in the transport mode.

20. The convertible hard side shelter of claim 1 further comprising means for assisting the side section floor to rotate.

21. The convertible hard side shelter of claim 1 further comprising:

a. at least one winch received in a selected frame post; and b. a cable between the at least one winch and the side section floor, so that operating the winch and cable assists the side section floor to rotate.

22. The shelter of claim 1 wherein the center section further comprises:

a. a generally horizontal bar on the front end; and b. a pair of channels under the horizontal beams that cooperate with the horizontal bar and a pallet loading system to enable the shelter to be handled and transported when in the transport mode.

23. The shelter of claim 1 further comprising means for selectively locking the top and bottom doors to associated center section corner posts.

24. The shelter of claim 1 further comprising means for locking the first and second end panels and the first and second middle panels to the center section floor when the shelter in is the transport mode, and to the side section floor when the shelter is in the deployed mode.

25. The shelter of claim 1 further comprising means for locking the door assembly to the side section floor when the shelter is in the deployed mode.

26. The shelter of claim 1 wherein the door assembly comprises a first: door frame turnably mounted to the first middle panel, and a second door frame turnably mounted to the second middle panel, the first and second door frames being selectively attachable to and detachable from each other.

27. The shelter of claim 26 wherein:

a. the first door frame comprises at least one side door; and b. the second door frame comprises a filler panel.

28. The shelter of claim 26 wherein:

a. the first and second door frames are attached to each other when the shelter is in the deployed mode; and b. the first and second door frames are detached from each other and lie flat against the respective first and second middle panels when the shelter is in the transport mode.

29. The shelter of claim 1 further comprising:

a. first locking bars on the first and second end panels that engage the associated side section floor when the shelter is in the deployed mode and that engage the center section floor when the shelter is in the transport mode; and b. second locking bars on the first and second middle panels that engage the associated side section floor when the shelter is in the deployed mode and that engage the center section floor when the shelter is in the transport mode.

30. The shelter of claim 29 further comprising third locking bars on the door assembly that engage the associated side section floor when the shelter is in the deployed mode.

31. The shelter of claim 1 further comprising means for retaining the side section floor vertical.

32. The shelter of claim 1 further comprising at least one winch received in a selected frame corner post, and a flexible cable between the at least one winch a selected side section floor, so that operating the at least one winch assists to rotate the side section floor.

* * * * *